US012188313B2

(12) United States Patent
Hiorth

(10) Patent No.: US 12,188,313 B2
(45) Date of Patent: Jan. 7, 2025

(54) WELL TOOL DEVICE FOR TRANSPORTING A HEAT GENERATING MIXTURE INTO A WELL PIPE

(71) Applicant: Interwell Norway AS, Hafrsfjord (NO)

(72) Inventor: Espen Hiorth, Trondheim (NO)

(73) Assignee: Interwell Norway AS, Hafrsfjord (NO)

( * ) Notice: Subject to any disclaimer, the term of this patent is extended or adjusted under 35 U.S.C. 154(b) by 0 days.

(21) Appl. No.: 18/248,953

(22) PCT Filed: Oct. 14, 2021

(86) PCT No.: PCT/EP2021/078392
§ 371 (c)(1),
(2) Date: Apr. 13, 2023

(87) PCT Pub. No.: WO2022/084129
PCT Pub. Date: Apr. 28, 2022

(65) Prior Publication Data

US 2023/0392462 A1 Dec. 7, 2023

(30) Foreign Application Priority Data

Oct. 20, 2020 (NO) ..... 20201128

(51) Int. Cl.
*E21B 23/01* (2006.01)
*E21B 23/04* (2006.01)
*E21B 33/13* (2006.01)

(52) U.S. Cl.
CPC ..... *E21B 23/01* (2013.01); *E21B 23/0411* (2020.05); *E21B 33/13* (2013.01)

(58) Field of Classification Search
CPC combination set(s) only.
See application file for complete search history.

(56) References Cited

U.S. PATENT DOCUMENTS 2,076,308 A * 4/1937 Wells ..... E21B 36/00 166/300
6,273,189 B1 * 8/2001 Gissler ..... E21B 4/04 166/241.1

(Continued)

FOREIGN PATENT DOCUMENTS

WO 2006/098634 A1 9/2006
WO 2010/147476 A1 12/2010

(Continued)

OTHER PUBLICATIONS

International Search Report issued in corresponding International Application No. PCT/EP2021/078392, mailed on Dec. 20, 2021 (5 pages).

(Continued)

*Primary Examiner* — Caroline N Butcher
(74) *Attorney, Agent, or Firm* — Osha Bergman Watanabe & Burton LLP

(57) ABSTRACT

A well tool device for transporting a heat generating mixture into a well pipe includes an upper connection section, a main housing section, and an anchoring device. The main housing section includes a compartment for the heat generating mixture. The anchoring device is connected between the upper connection section and the main housing section. The main housing section includes a compartment subsection and a distance subsection. The compartment is located within the compartment subsection. The distance subsection is located above the compartment subsection.

13 Claims, 11 Drawing Sheets

(56) References Cited

U.S. PATENT DOCUMENTS

| | | | | |
|---|---|---|---|---|
| 2002/0170713 | A1 | 11/2002 | Haugen et al. | |
| 2006/0144591 | A1* | 7/2006 | Gonzalez | E21B 29/10 166/57 |
| 2007/0284097 | A1 | 12/2007 | Swor et al. | |
| 2014/0190684 | A1* | 7/2014 | Hiorth | E21B 33/1216 166/203 |
| 2015/0211312 | A1* | 7/2015 | Krueger, V | E21B 4/18 294/86.24 |

FOREIGN PATENT DOCUMENTS

| | | | | |
|---|---|---|---|---|
| WO | 2013/135583 | A3 | 6/2014 | |
| WO | 2017/035537 | A1 | 3/2017 | |
| WO | 2017/137226 | A1 | 8/2017 | |
| WO | 2019/112438 | A1 | 6/2019 | |
| WO | WO-2019194680 | A1 * | 10/2019 | E21B 23/00 |
| WO | 2020/183187 | A1 | 9/2020 | |

OTHER PUBLICATIONS

Written Opinion issued in corresponding International Application No. PCT/EP2021/078392, mailed on Dec. 20, 2021 (9 pages).
International Preliminary Report on Patentability issued in corresponding International Application No. PCT/EP2021/078392, mailed on Sep. 26, 2022 (13 pages).
Search Report issued in counterpart Norwegian Patent Application No. 20201128 mailed on Apr. 15, 2021 (2 pages).

* cited by examiner

WELL TOOL DEVICE FOR TRANSPORTING A HEAT GENERATING MIXTURE INTO A WELL PIPE

FIELD OF THE INVENTION

The present invention relates to a well tool device for transporting a heat generating mixture into a well pipe. The well tool device comprises an anchoring device.

BACKGROUND OF THE INVENTION

In WO 2013/135583 (Interwell Technology) it is described a method for abandoning a well or for removing a well element. First, a heat generating mixture is lowered to the desired position in the well. Then, the heat generating mixture is ignited to start a heat generating process. The result of the heat generating process will depend on the type of, and the amount of, heat generating mixture, and may be that a well element at the desired position becomes removed or cleared, or that several concentric well elements and the material located between the well elements becomes melted and subsequently solidified to form a plug or barrier in the well.

The heat generating mixture may for example be thermite and the heat generating process will be a exothermic oxidation-reduction reaction known as a thermite reaction.

The object of the present invention is to provide a well tool device for transporting a heat generating mixture into the well. One object is that the well tool device should be simple and cost-efficient to use.

SUMMARY OF THE INVENTION

The present invention relates to a well tool device for transporting a heat generating mixture into a well pipe, wherein the well tool device comprises:

- an upper connection section;
- a main housing section comprising a compartment for the heat generating mixture;
- an anchoring device connected between the upper connection section and the main housing section;
- wherein the main housing section comprises a compartment subsection and a distance subsection, where the compartment is located within the compartment subsection and where the distance subsection is located above the compartment subsection.

In one aspect, a height of the distance subsection is more than 2 meters, preferably more than 4 meters and even more preferred more than 5 meters.

In one aspect, the anchoring device comprises:

- an upper link element pivotably connected to the upper connection section;
- a lower link element pivotably connected to the distance section;
- a radially outwardly facing surface with serrations for engaging the well pipe in the set state;
- wherein a length of the upper link element is longer than a length of the lower link element.

In one aspect, the radially outwardly facing surface is provided on the upper link element or on the lower link element or on a slips element pivotably connected between the upper link element and the lower link element.

In one aspect, the well tool device has a central longitudinal axis. A radial plane is defined as a plane perpendicular to the central longitudinal axis.

In one aspect, the length of the upper link element is measured between pivoting points of the upper link element and the length of the lower link element is measured between pivoting points of the lower link element.

In one aspect, the anchoring device has a run state, in which the slips element is radially retracted, and a set state, in which the slips element is radially expanded against the well pipe.

In one aspect, the anchoring device is configured to be in a radially retracted or run state when lowered into the well pipe and where the anchoring device is configured to be in a radially expanded or set state when arriving at the desired location in the well pipe.

In one aspect, an upper end of the upper link element is pivotably connected to the upper connection section and a lower end of the upper link element is pivotably connected to an upper end of the slips element; and wherein an upper end of the lower link element is pivotably connected to a lower end of the slips element and a lower end of the lower link element is pivotably connected to the distance subsection.

In one aspect, a weight of the main housing section is configured to pull the anchoring device to a radially retracted state when the well tool device is suspended from a wire or wireline connected to the upper connection section.

The weight of the main housing section is here referring to the weight of the well tool being suspended from the lower link element of the anchoring device.

In one aspect, a weight of the upper connection section is configured to push the anchoring device to a radially expanded state when the well tool device below the anchoring device is held stationary with respect to the well pipe.

The well tool device may be held stationary by lowering the well tool device onto an object secured relative to the well pipe. The platform may be a plug set in the well pipe, it may be an inwardly protruding part of the well pipe, it may be an upper end of a pipe string section located inside the well pipe, an upper end of a cement column within the well pipe etc.

In one aspect, the serrated surface is configured to prevent upwardly directed movement of the main housing section after ignition of the heat generating mixture.

In one aspect, the slips element comprises a first, inwardly facing, stop engaging a center rod of the well tool device in the radially retracted state, causing a lower angle between the lower link element and the center rod to be more than 0° and/or causing an upper angle defined between the upper link element and the center rod to be more than 0°.

The purpose of the stop is to ensure that the anchoring device will be able to move radially out to the radially expanded state.

In one aspect, the slips element comprises a first stop; wherein the lower link element comprises a second stop, wherein a lower angle between the lower link element and a longitudinal center axis of the well tool device has a maximum value when the first stop and the second stop is engaged with each other.

In one aspect, the maximum value is 85-89°. The purpose of the stops is to ensure that the anchoring device will be able to move back to the radially retracted state.

In one aspect, the slips element further comprises a third, inwardly facing stop for engaging the center rod of the well tool device in the radially retracted or run state.

In one aspect, the well tool device comprises three sets of upper link elements, slips elements and lower link elements distributed around the circumference of the anchoring device. The three sets of upper link elements, slips elements and lower link elements are distributed with 120° between each set. Alternatively, four sets of upper link elements, slips elements and lower link elements are distributed with 90° between each set of wheels. In yet an alternative, there may be only one set, the one set comprising one upper link element, one slips element and one lower link element.

In one aspect, the well tool device comprises a wheel section comprising a set of wheels.

In one aspect, the wheels are provided a first radial distance from a longitudinal center axis of the well tool device, wherein the radially protruding surface of the slips element is provided at a second radial distance from a longitudinal center axis of the well tool device, the first radial distance being larger than the second radial distance.

In one aspect, the wheel section comprises three wheels. The purpose of the wheel section is to reduce friction during running of the well tool device into the well pipe and to reduce friction during retrieval of at least parts of the well tool device from the well pipe. The purpose of the wheel section is also to center the well tool device in the well pipe. In one aspect, the wheel section is provided axially between the anchoring device and the upper connection section.

In one aspect, the wheel section is a part of the anchoring device, where the wheels and the upper end of the upper link element are connected to a common bracket.

In one aspect, the distance subsection comprises an elongated housing outside of the center rod. The purpose of the distance subsection is to increase the distance between the anchoring device and the main housing section. During the heat generation process, the distance subsection is designed to at least partially melt, allowing the upper connection section, the anchoring device and the non-melted parts of the distance subsection to be retrieved from the well pipe.

In one aspect, the well tool device comprises an igniting device for igniting the heat generating mixture. The igniting device may be trigged by an electric signal received via a wire connected to the upper connection interface. Alternatively, the ignition device may be trigged by a wireless signal, a timer, a pressure sensor, etc.

In one aspect, the upper connection section comprises a connection interface. The connection interface a may be a wire or wireline connection interface. No setting and/or retrieval tool is needed to set and/or retrieve the well tool device—a wire or wireline is sufficient.

Heat from the molten heat generating mixture will be drawn via the thimble-shaped elements to the lower end of the main housing section and to the lower supporting element. Hence, the lower end of the main housing section and the lower supporting element are working as a heat-sink, for cooling the thimble-shaped elements.

The term "slips element" is used herein to describe an element having an outwardly facing serrated surface having at least one tooth, wherein the serrated surface is capable of engaging with the inner surface of the well pipe and hence prevent upwardly and/or downwardly movement of the slips element. Typically, the serrated surface will comprise a number of teeth adjacent to each other. The tooth/teeth of the serrated surface may be shaped to prevent upwardly movement only, downwardly movement only, or both upwardly and downwardly movement.

In one aspect, the well tool device further comprises:

a sealing device provided below the main housing section;

wherein the sealing device comprises:

a lower supporting element comprising a lower wedging surface;

an upper wedging surface faced towards the lower wedging surface;

a sealing ring provided between the lower wedging surface and the upper wedging surface;

wherein the sealing element comprises a plurality of thimble-shaped elements inserted into each other to form a torus;

wherein relative axial movement between the lower wedging surface and the upper wedging surface in a direction towards each other provides radial expansion of the sealing element.

The upper wedging surface and the lower wedging surface are provided radially outside of, and circumferentially around, the longitudinal axis.

In one aspect, the upper wedging surface is provided in a lower end of the main housing section.

In one aspect, the lower supporting element is displaceable in relation to the main housing section in the longitudinal direction.

In one aspect, the lower supporting element is connected to the main housing section by means of a bolt.

In one aspect, the lower supporting element is slidingly arranged around the bolt. Hence, the bolt allows relative axial movement between the lower wedging surface and the upper wedging surface.

In one aspect, the bolt comprises a head section, a threaded end section and an intermediate non-threaded section between the head section and the threaded end section. In one aspect, the threaded end section is threadedly connected to a threaded opening provided in the lower end of the main housing section. The lower supporting element comprises a through bore slidingly arranged around the intermediate non-threaded section of the bolt.

In one aspect, the thimble-shaped elements are made of a metal or a metal alloy.

Hence, a metal-to-metal seal is provided when the sealing element is radially expanded into contact with the well pipe. The purpose of the metal-to-metal seal is to prevent or at least considerably reduce molten heat generating mixture to flow down to the area below the well tool device during the heat generation process. The purpose of the metal-to-metal seal is also to prevent or at least considerably reduce fluid heated by the heat generation process to rise from the area below the well tool device and up into the molten heat generating mixture during the heat generation process, as this may impact the process negatively.

Alternatively, the thimble-shaped elements are not expanded entirely into contact with the well pipe. The radially expanded sealing ring will still reduce molten heat generating mixture to flow down and/or reduce fluid heated by the heat generation process to rise.

In one aspect, the well tool device comprises several sealing elements above each other, each sealing element comprising a plurality of thimble-shaped elements inserted into each other to form a torus.

Alternatively, the thimble-shaped elements are made of a ceramic or another suitable heat-resistant material.

In one aspect, the thimble-shaped elements may be coated. The thimble-shaped elements may be coated with a high-temperature polymer.

In one aspect, each of the thimble-shaped elements comprises a through bore, where the thimble-shaped elements are connected to each other by means of a connection element inserted through the respective bores.

In one aspect, the connection element is a wire. The connection element may be elastic for biasing the sealing element towards the radially retracted state. In one aspect, the connection element is a spiral spring. In one aspect, the connection element is a spiral spring for biasing the sealing element towards the radially retracted state.

In one aspect, the sealing device further comprises a ratchet device configured to allow relative axial movement between the lower wedging surface and the upper wedging surface in a direction towards each other while preventing relative axial movement between the lower wedging surface and the upper wedging surface in a direction away from each other.

In one aspect, a weight of the main housing section is configured to force the sealing device from the radially retracted state to the radially expanded state when the lower supporting element is held stationary with respect to the well pipe.

The well tool device may be held stationary by lowering the well tool device onto an object secured relative to the well pipe. The platform may be a plug set in the well pipe, it may be an inwardly protruding part of the well pipe, it may be an upper end of a pipe string section located inside the well pipe.

In one aspect, the lower supporting element comprises a downwardly facing, substantially planar, supporting surface.

The downwardly facing supporting surface is configured to be supported against a supporting surface provided in the well pipe.

In one aspect, the supporting surface may be a part of a plug set in the well pipe.

In one aspect, the lower wedging surface is facing generally upwards, while the upper wedging surface is facing generally downwards.

The term "upper", "above", "lower", "below" etc. are used herein as terms relative to the well. Parts referred to as "upper" or "above" are relatively closer to the top of the well than the parts referred to as "lower" or "below", which are relatively closer to the bottom of the well, irrespective of the well being a horizontal well, a vertical well or an inclining well.

DETAILED DESCRIPTION

Embodiments of the invention will now be described with reference to the enclosed drawings, where:

Figure 10A:
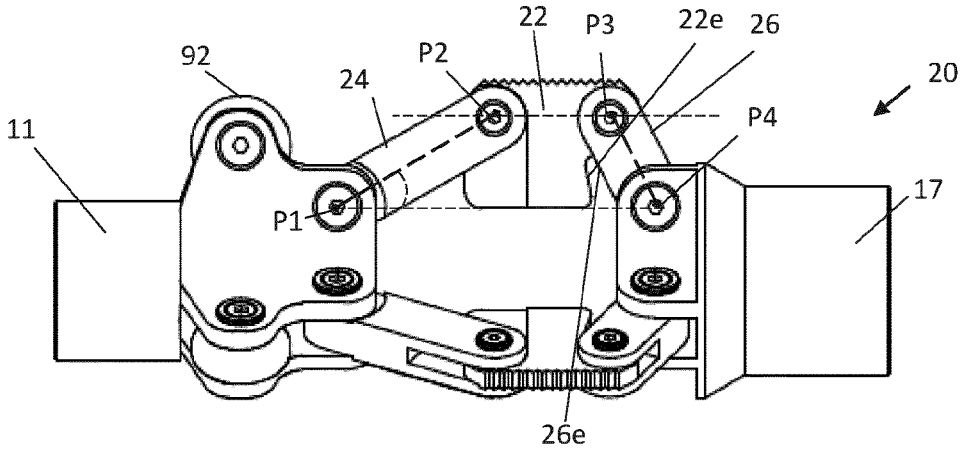
Figure 10B:
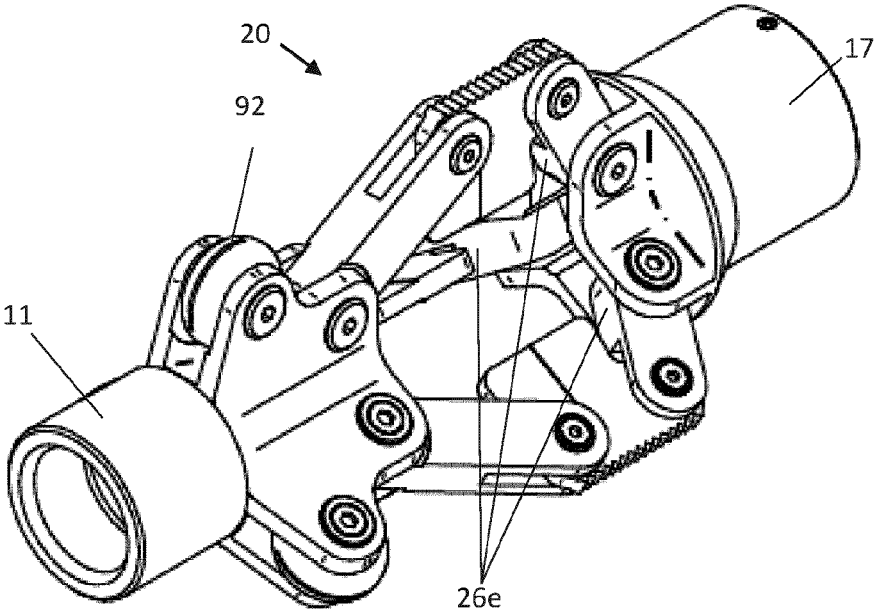
Figure 10C:
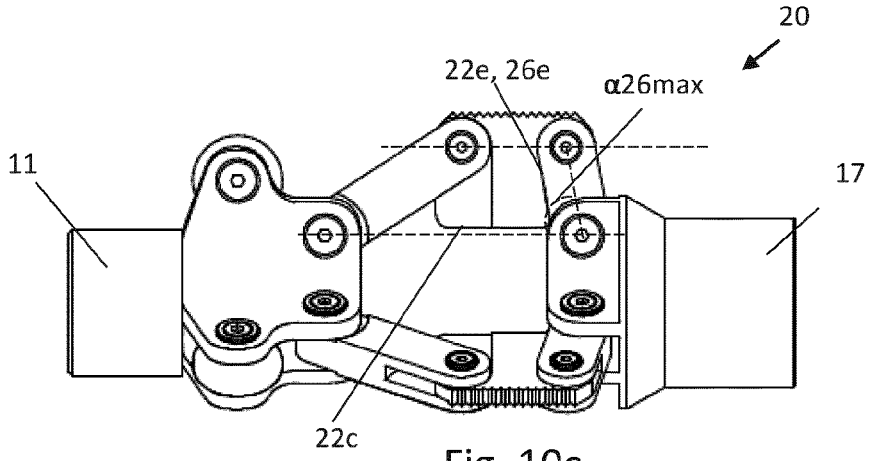
Figure 10D:
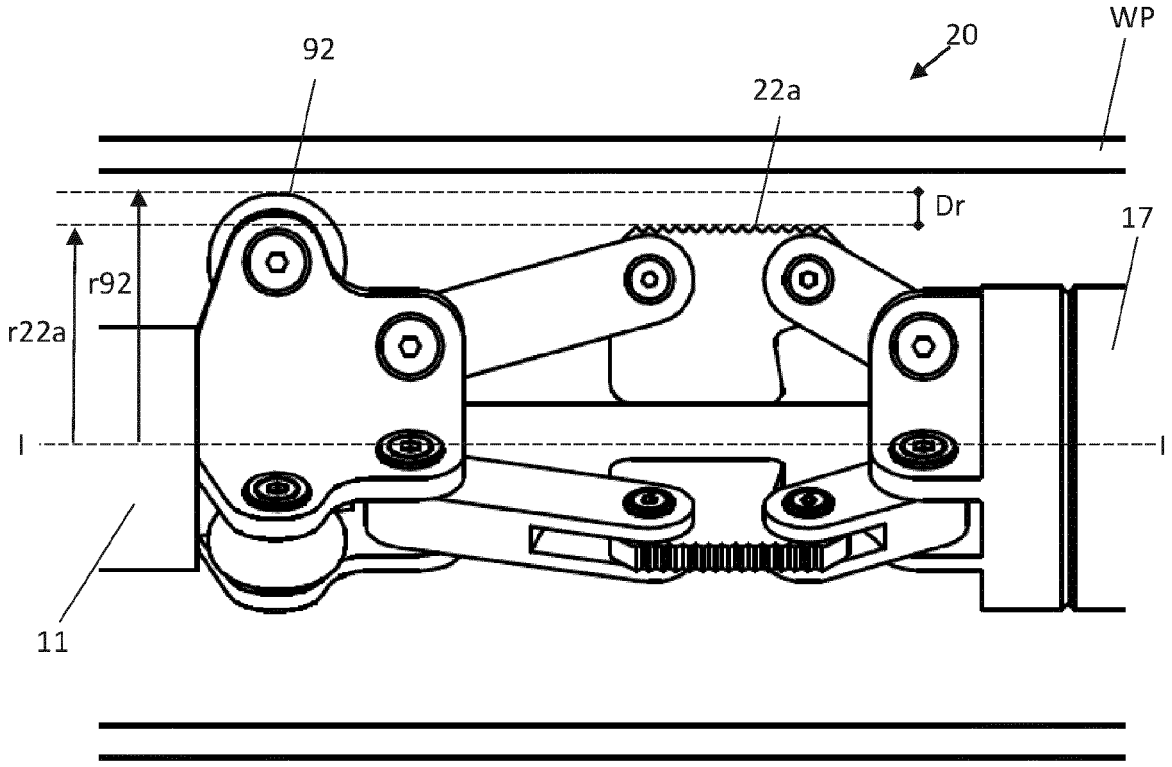

FIG. 10*a* illustrates a side view of the anchoring device in an intermediate state between the run and set states (center rod removed from drawing);

FIG. 10*b* illustrates a perspective view of the anchoring device in the intermediate state (center rod removed from drawing);

FIG. 10*c* illustrates a side view of the anchoring device in the set state (center rod removed from drawing);

FIG. 10*d* illustrates a side view of the anchoring device in the run state;

FIG. 11*a-g* illustrates the steps of using the well tool device for performing a plugging and abandonment operation or for performing a well element removal operation.

Figure 13A:
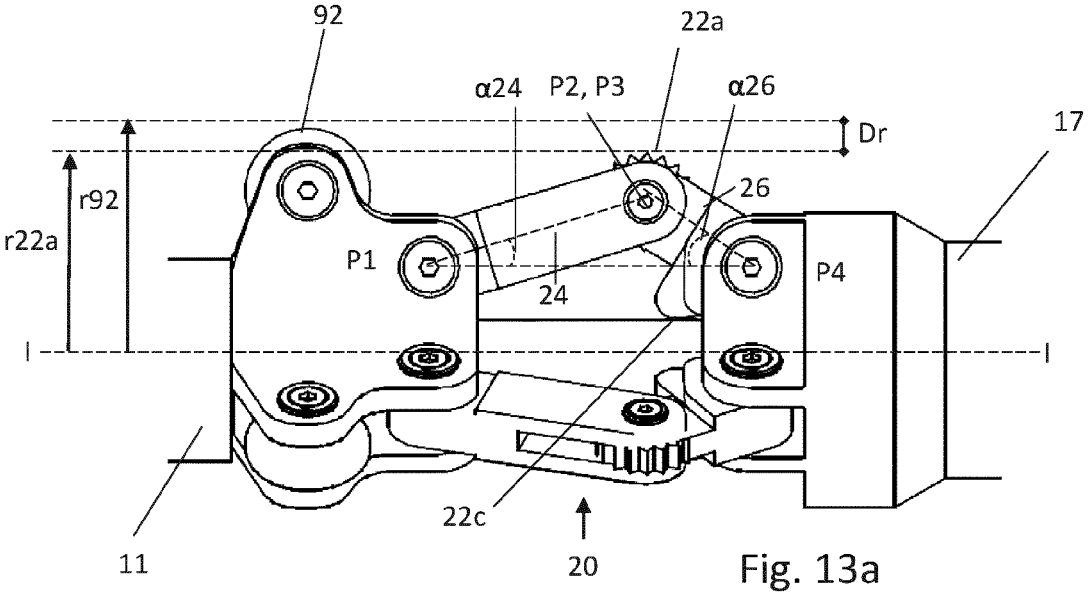
Figure 13B:
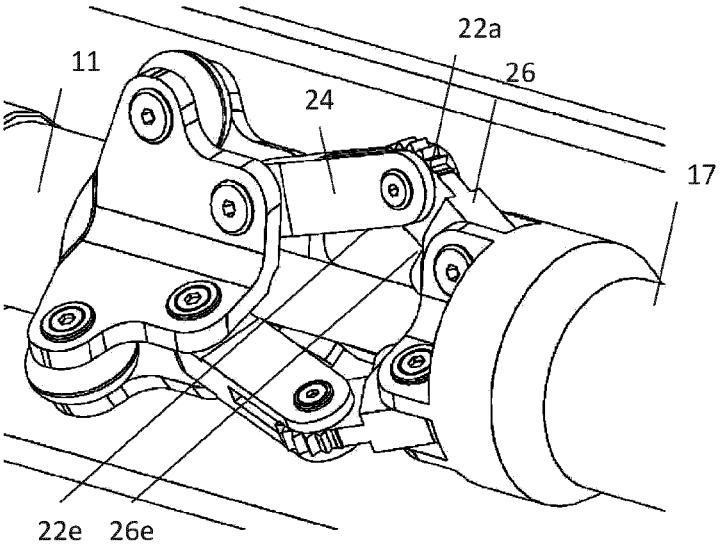

FIG. 12*a-d* illustrate details of the interconnected chain elements;

FIG. 13*a* shows a side view of an alternative embodiment of the anchoring in the run state;

FIG. 13*b* shows a perspective view of FIG. 13*a;*

Figure 13C:
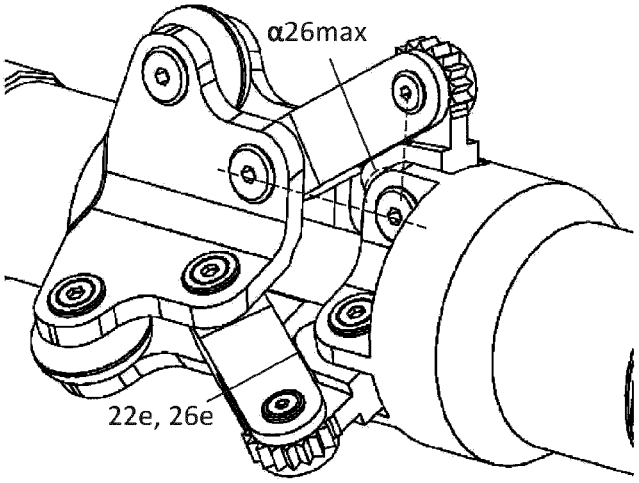

FIG. 13*c* shows a perspective view of the alternative embodiment of the anchoring device in the set state.

Figure 1:
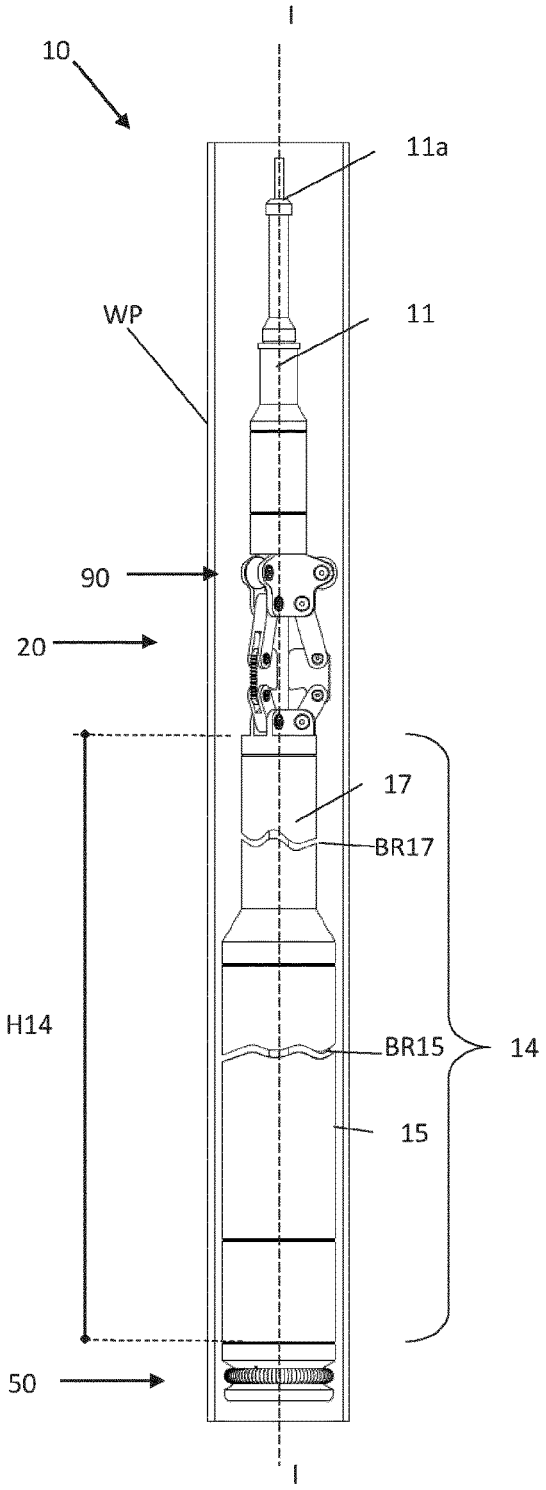
FIG. 1 shows the well tool device in a radially retracted or run state.
Figure 2:
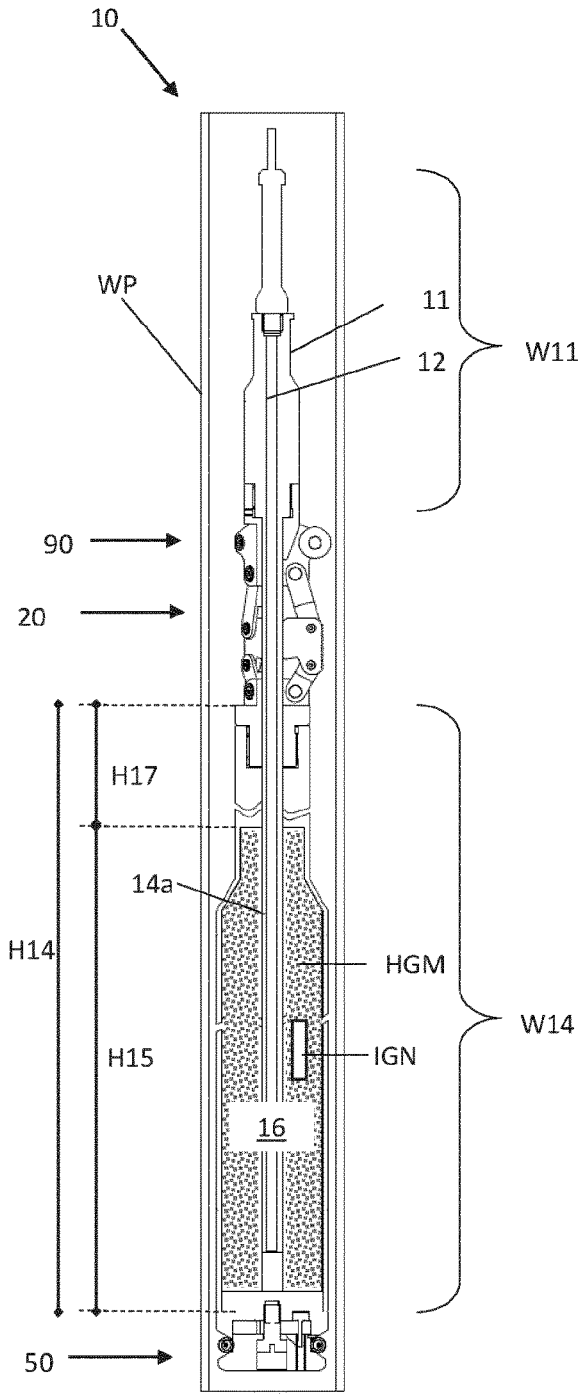
FIG. 2 shows a partial cross section of the well tool device in the run state.

It is now referred to FIGS. 1 and 2, where a well tool device 10 is disclosed within a well pipe WP. The purpose of the well tool device 10 is to transport a heat generating mixture HGM to a desired location within an oil and/or gas well. The well is typically provided with a well pipe WP cemented or in other ways secured inside the well.

The heat generating mixture HGM will, when ignited by an igniting device IGN, start a heat generating process. One such heat generating process may be a part of a plugging and abandonment operation as described in WO 2013/135583, i.e. to melt surrounding materials to form a solid plug. Another such heat generating process may be a part of a well pipe removal operation, where the well pipe WP (and possibly also other well pipes radially outside of the inner well pipe WP) becomes at melted or least partially melted. The purpose of the latter operation may be to expose the rock of the well. Yet another such heat generating process may be to provide heat, for example to heat a metal, a metal alloy or another material to its liquid state during a period of time.

In FIG. 1 and FIG. 2, it is described that the well tool device 10 comprises a connection section 11, a main housing section 14, an anchoring device 20 and a sealing device 50. In addition, the well tool device 10 may comprise a wheel section 90. These parts will be described in detail below.

Centrally within the well tool device 10 is a mandrel or central rod 12. The central rod 12 is secured to the connection section 11. Other parts of the well tool device 10 is slidingly engaged outside of the central rod 12, as will be apparent from the description below.

It is further shown in FIG. 1 that the well tool device 10 is defined with a longitudinal center axis I-I, where a radial plane is defined as a plane perpendicular to the central longitudinal axis I-I.

Connection Section 11

It is now referred to FIGS. 1, 2, 4 and 5. The connection section 11 is provided in the upper end of the well tool device 10 and comprises a connection interface 11*a*. The connection interface 11*a* may be a wire or wireline connection interface. A wire or wireline (not shown) is connected directly to the connection interface 11*a*. Hence, in the present embodiment, no setting tool is required to run and set the well tool device 10 at the desired location in the well. No retrieval tool is used when retrieving the tool or parts of the tool either.

Main Housing Section 14

It is now referred to FIG. 1-5. The main housing section 14 is provided above the sealing device 50 and below the anchoring device 20. The main housing section 14 comprises a compartment subsection 15 and a distance subsection 17 located above the compartment subsection 15.

The compartment subsection 15 comprises an outer housing 15*a* and a compartment 16 located within the outer housing 15*a*. The lower end of the outer housing 15*a* is closed. The upper end of the outer housing 15*a*, i.e. The transition area between the compartment subsection 15 and the distance section 17 is also closed. Hence, the compartment 16 is a closed compartment.

Figure 3:
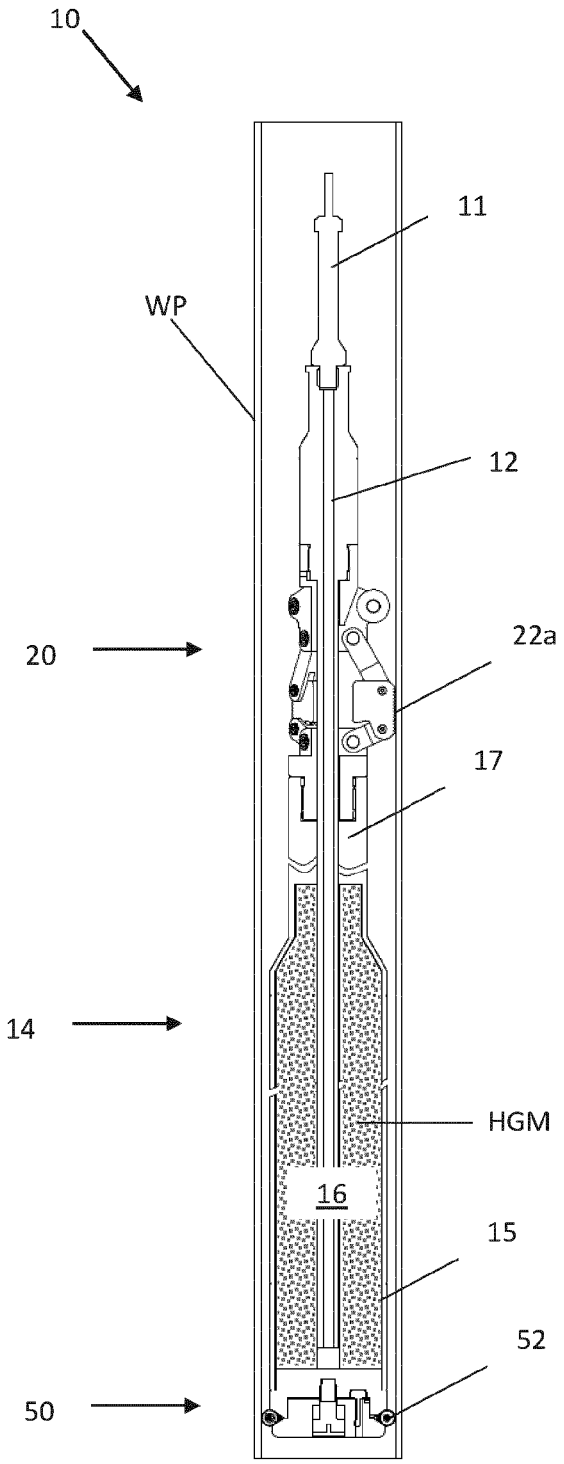
FIG. 3 shows a partial cross section of the well tool device in a radially expanded or set state.
Figure 4:
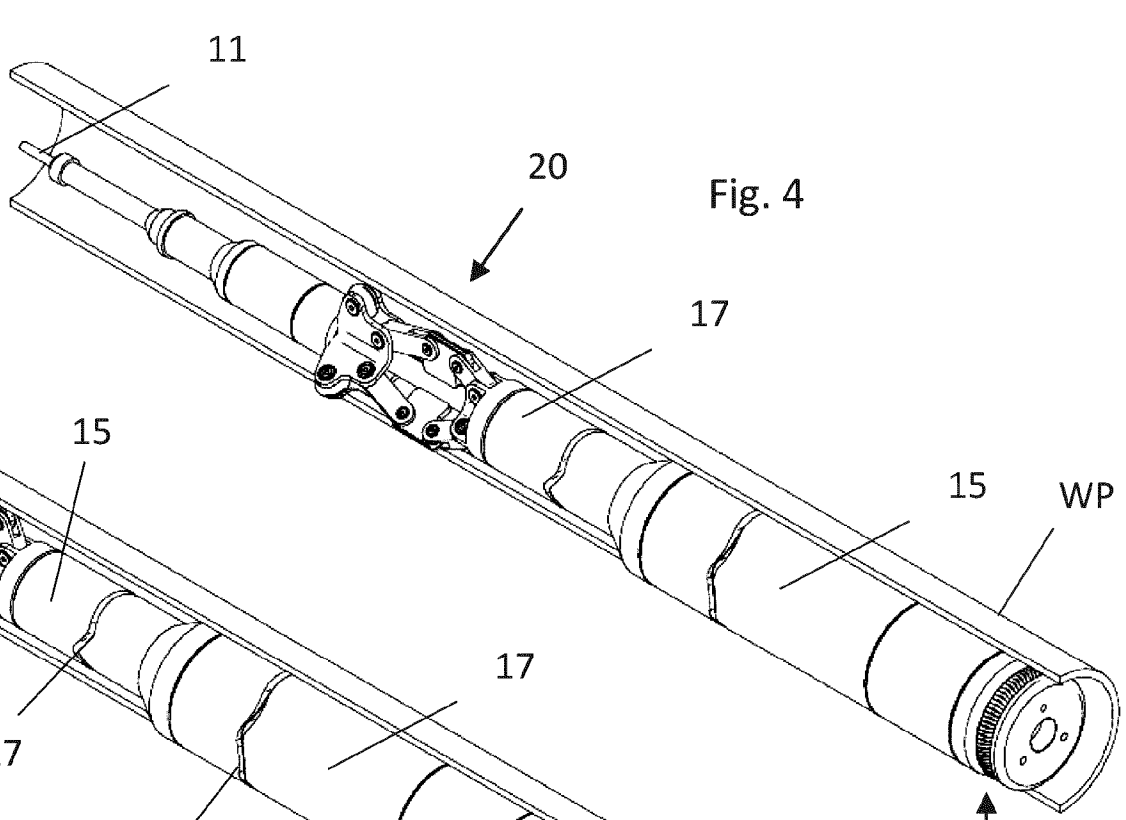
FIG. 4 shows a perspective view of the tool in the run state.
Figure 5:
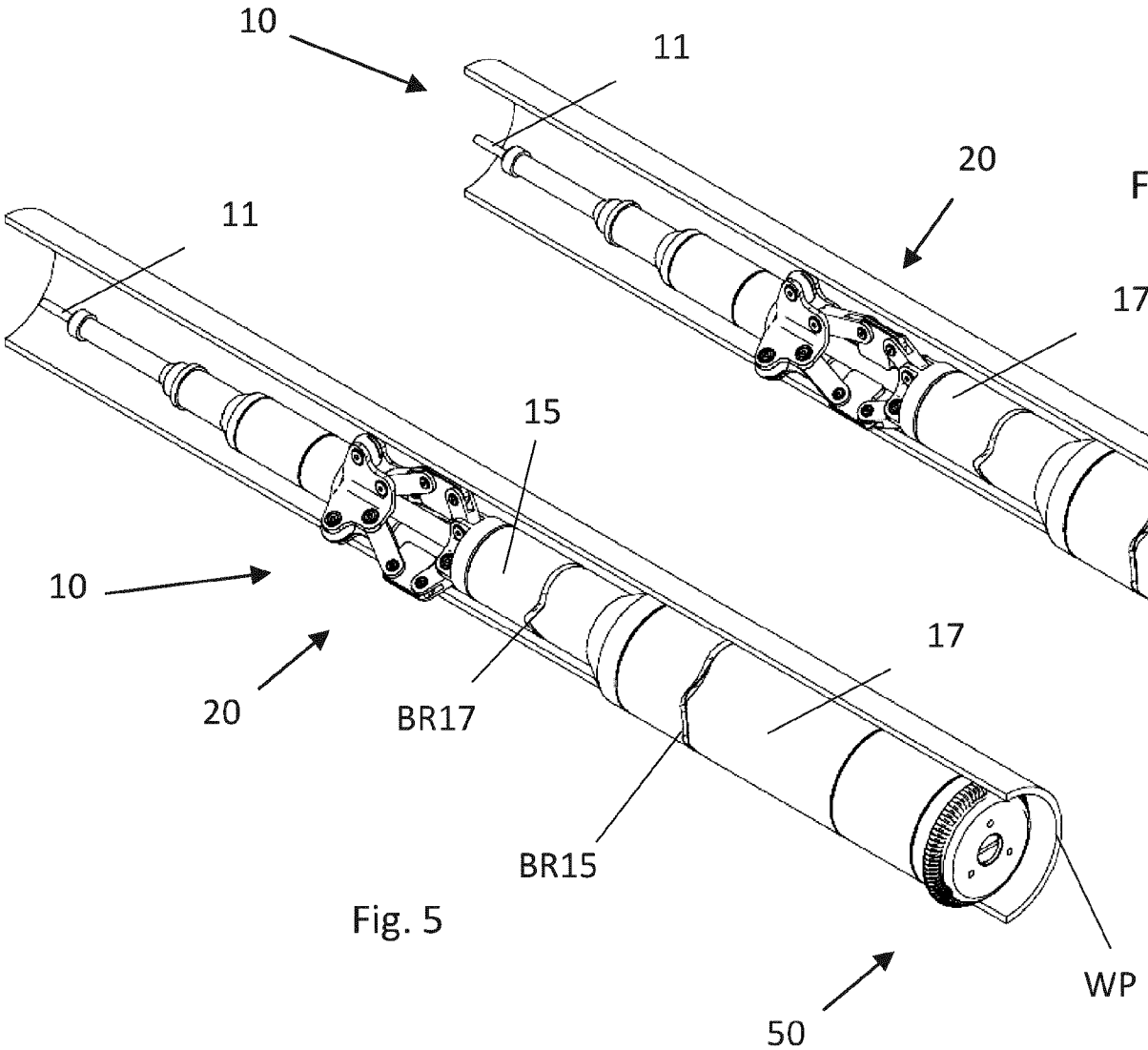
FIG. 5 shows a perspective view of the tool in the set state.

The compartment 16 will typically contain the heat generating mixture HGM. In FIGS. 2 and 3 the heat generating mixture HGM is shown as a particulate matter. However, it should be noted that the heat generating mixture HGM may comprise one solid piece of a heat generating material or it may comprises heat generating material in the form of a slurry or fluid.

Figure 6:
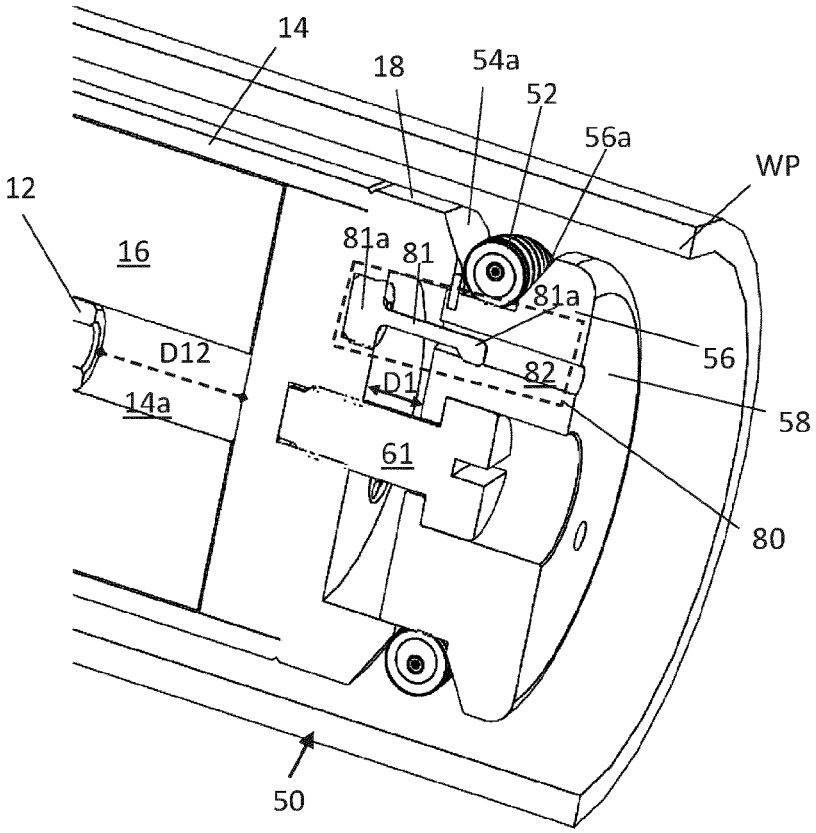
FIG. 6 shows an enlarged cross sectional perspective view of the sealing device in the run state.
Figure 7:
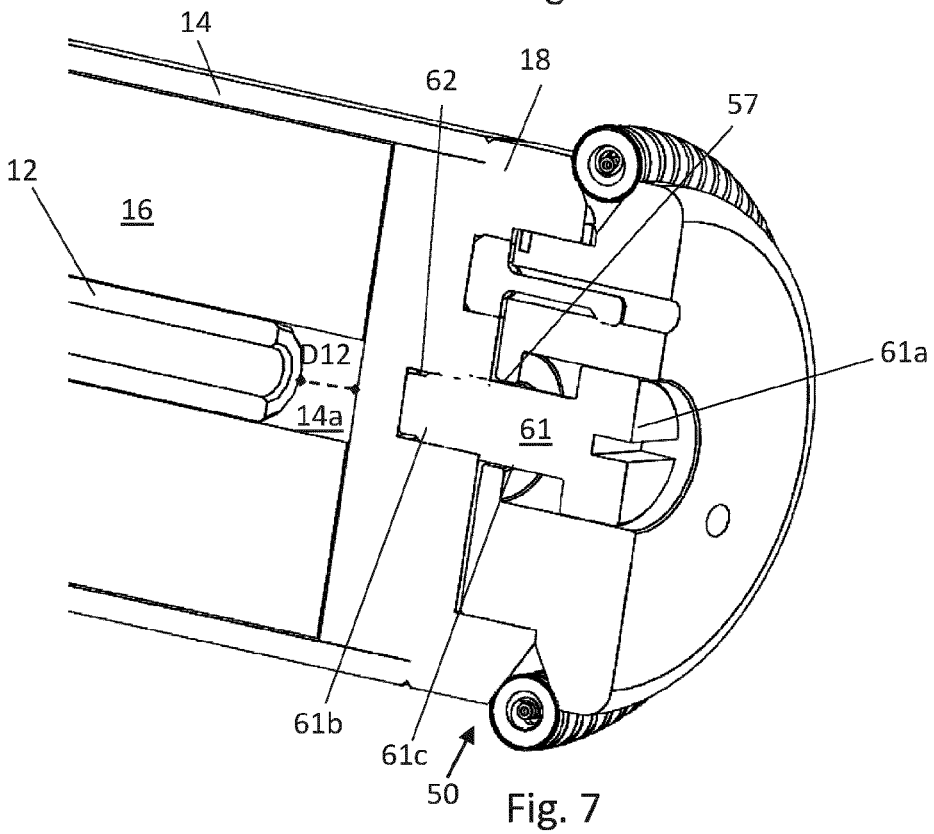
FIG. 7 shows an enlarged cross sectional perspective view of the sealing device in the set state.

As shown in FIG. 2, the main housing section 14 comprises a bore 14*a* in which the center rod 12 is provided. The center rod 12 is axially displaceable in the bore 14*a*. This is also shown in FIGS. 6 and 7, where a distance D12 between a lower end of the rod 12 and a lower end of the bore 14*a* is longer in the run state (FIG. 6) than in the set state (FIG. 7).

In FIGS. 1 and 2 it is shown that the main housing section 14 has a height H14, the compartment subsection 15 has a height H15 and the distance section 17 has a height H17. The height H14 is substantially equal to the sum of heights H15 and H17. It should be noted that the height H15 may be substantially larger than shown in the drawings, as indicated by break line BR15. The height H15 will be dependent on the amount of heat generating mixture HGM needed for the operation. It should also be noted that the height H17 may be substantially larger than shown in the drawings, as indicated by break line BR17. The purpose of the distance subsection 17 is to create a distance between the anchoring device 20 and the heat generating mixture HGM, to avoid that the heat generating process melts the anchoring device in the heat generating process or in an early phase of the heat generating process. The height H17 of the distance subsection 17 may be more than 2 meters, preferably more than 4 meters and even more preferred more than 5 meters.

Anchoring Device 20

The anchoring device will now be described with reference to FIGS. 8, 9 and 10*a*-10*d*.

The anchoring device 20 is connected between the upper connection section 11 and the distance section 17. The anchoring device 20 comprises a slips element 22 with a radially outwardly facing surface 22*a* with serrations for engaging the well pipe WP in the set state. The anchoring device 20 further comprises an upper link element 24 pivotably connected between the upper connection section 11 and the slips element 22 and a lower link element 26 pivotably connected between the slips element 22 and the main housing section 14. An upper end 24*a* of the upper link element 24 is pivotably connected to the upper connection section 11 at a first pivoting point P1 and a lower end 24*b* of the upper link element 24 is pivotably connected to an upper end of the slips element 22 at a second pivoting point P2. An upper end 26*a* of the lower link element 26 is pivotably connected to a lower end of the slips element 22 at a third pivoting point P3 and a lower end 26*b* of the lower link element 26 is pivotably connected to the distance subsection 17 at a fourth pivoting point P4.

As described above, the center rod 12 is secured to, and hence fixed with respect to, the upper connection section 11. Hence, by axial displacement of the distance subsection 17 relative to the upper connection section 11, the anchoring device 20 can be moved between its radially retracted state and its radially expanded state.

A line drawn between the first and fourth pivoting points P1, P4 is preferably parallel to the central longitudinal axis I-I. Similarly, a line drawn between the second and third pivoting points P2, P3 when the anchoring device is in its run or set states is preferably parallel to the central longitudinal axis I-I.

The upper link element 24 has a length L24 measured between the first and second pivoting points P1, P2. The lower link element 26 has a length L26 measured between the third and fourth pivoting points P3, P4. The length L24 is longer than the length L26.

Figure 9:
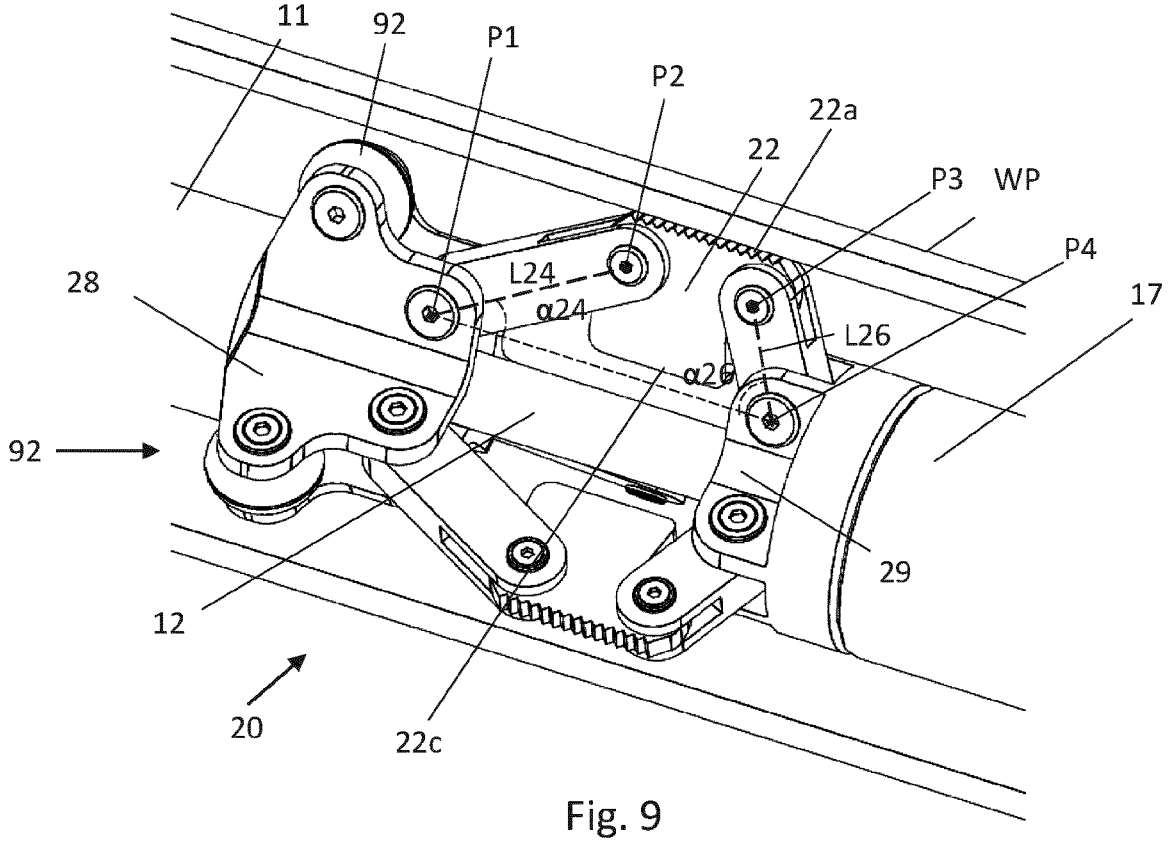
FIG. 9 shows an enlarged perspective view of the anchoring device in the set state.

In FIG. 9 it is further shown an upper angle α24 between the upper link element 24 and the longitudinal axis I-I. Here, the upper angle α24 is shown as the angle between a dashed line drawn between P1 and P4 (being parallel to the longitudinal axis I-I) and a dashed line drawn between P1 and P2.

Similarly, it is shown in FIG. 9 a lower angle α26 between the lower link element 26 and the longitudinal axis I-I. Here, the lower angle α26 is shown as the angle between a dashed line drawn between P1 and P4 (being parallel to the longitudinal axis I-I) and a dashed line drawn between P3 and P4.

In FIG. 10*a* it is shown that the slips element 22 comprises a first downwardly facing stop 22*e*. Moreover, it is shown that the lower link element 26 comprises a second, upwardly facing stop 26*e*. In FIG. 10*c*, it is shown that the first downwardly facing stop 22*e* is engaging the second, upwardly facing stop 26*e*, thereby defining a maximum value α26max for the lower angle α26. It is not possible to increase the lower angle α26 further than this maximum value α26max due to the stops 22*e*, 26*e*. The purpose of the stops 22*e*, 26*e* is to ensure that the anchoring device 20 will be able to move back to the radially retracted state.

Figure 8:
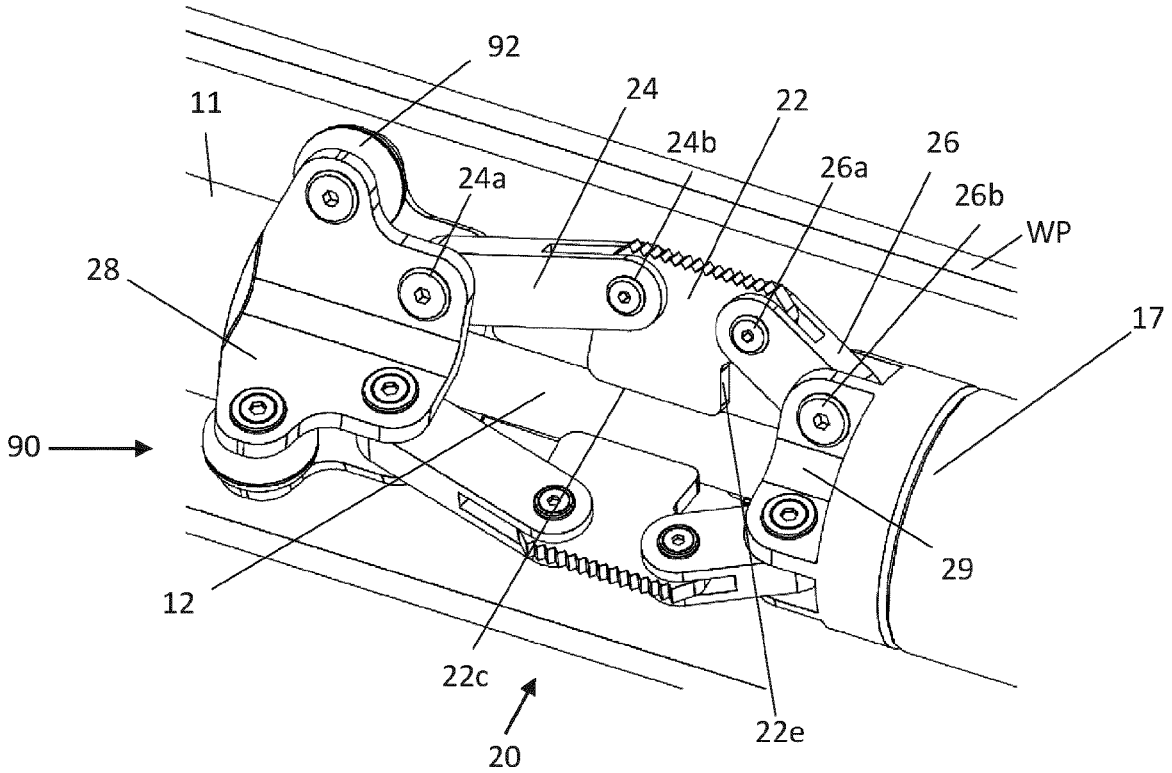
FIG. 8 shows an enlarged perspective view of the anchoring device in the run state.

In FIG. 10*c* it is shown that the slips element 22 further comprises a third, inwardly facing stop 22*c*. In FIG. 8, it is shown that this inwardly stop 22*c* is engaging the center rod 12 of the well tool device 10 in the radially retracted or run state. The purpose of the third stop 22*c* is to ensure that the lower angle α26 between the lower link element 26 and the center rod 12 is more than 0° and/or to ensure that the upper angle α24 defined between the upper link element 24 and the center rod 12 is more than 0°.

Consequently, the stop 22*c* will ensure that the anchoring device 20 will be able to move radially out to from the radially retracted state to the radially expanded state.

The preferred value for the maximum value α26max is 85-89°. In the embodiment shown in the drawings, the maximum value α26max is 87°.

The upper link element 24 may as an example have an angle α24 between 30-45° with respect to a longitudinal axis (I-I) in the radially expanded state.

As shown in the drawings, the well tool device 10 comprises three sets of upper link elements, slips elements and lower link elements distributed with 120° between each set around the circumference of the center rod 12.

Alternatively, four sets of upper link elements, slips elements and lower link elements may be distributed with 90° between each set around the circumference of the center rod 12.

Sealing Device 50

It is now referred to FIGS. 6 and 7. The sealing device 50 is provided below the main housing section 14.

The sealing device 50 comprises a sealing ring 52. The sealing ring 52 is shown in detail in FIGS. 12*a*, 12*b*, 12*c* and 12*d* and comprises a plurality of thimble-shaped elements 70 inserted into each other to form a torus. When viewed from the side as in FIG. 12*b*, each thimble-shaped element comprises an outwardly curved area 72, an inwardly curved area 73 and possibly a straight area 71 between the areas 72, 73.

The outwardly curved area 72 of one element is inserted into the inwardly curved area 73 of the adjacent element. The thimble-shaped elements 70 are known from US2014/0190684 (Interwell Technology AS), where a plugging device is described having a sealing element made of an elastomeric material, where the thimble-shaped elements are incorporated into the elastomeric material. The purpose of the thimble-shaped elements is to prevent or at least partially reduce extrusion of the elastomeric material in situations where there is a large pressure difference over the plug. Here, it is described that a wire may or may not be inserted through an opening 74 of the elements.

Figure 12A:
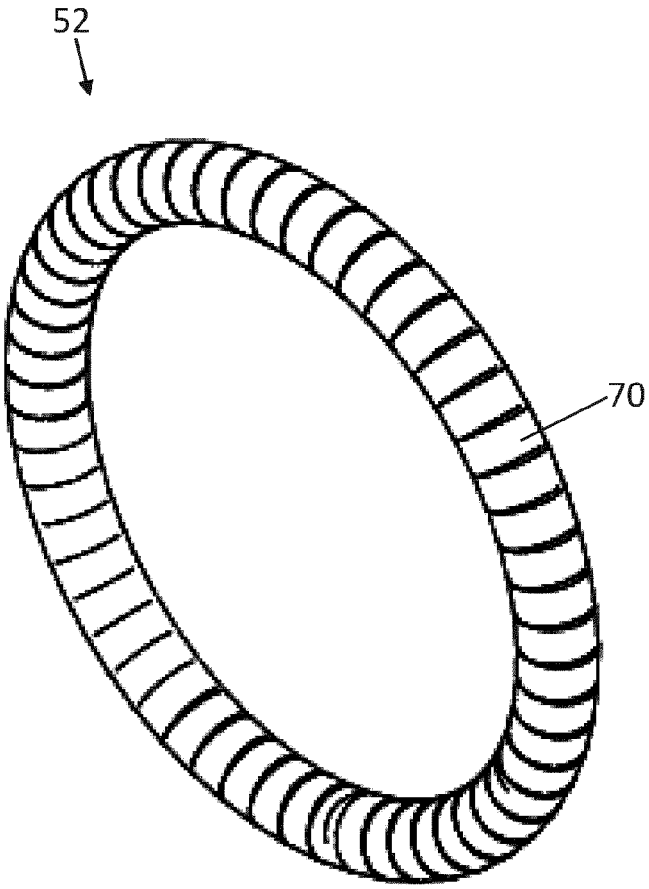
Figure 12B:
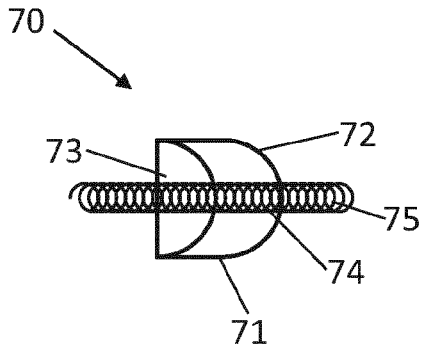
Figure 12C:
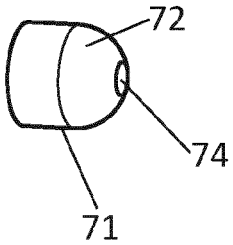
Figure 12D:
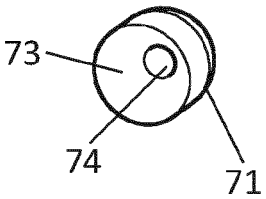

In the present sealing ring 52, the thimble-shaped elements 70 are connected to each other by means of a connection element 75 inserted through the respective bores 74. Here, the connection element 74 has the purpose of biasing the sealing element 52 to its radially retracted state. In FIG. 12*b*, it is shown that the connection element 75 is a spiral spring. Alternatively, the connection element 75 may be an elastic wire for biasing the sealing ring 52 towards the radially retracted state.

The thimble-shaped elements 70 are preferably made of a metal or a metal alloy. They may be coated with a high-temperature polymer. Alternatively, the thimble-shaped elements 70 are made of a ceramic or another suitable heat-resistant material.

The sealing device 50 further comprises a lower supporting element 56 comprising a lower wedging surface 56*a* and an upper wedging surface 54*a* faced towards the lower wedging surface 56*a*. The sealing ring 52 is provided between the lower wedging surface 56*a* and the upper wedging surface 54*a*. The upper wedging surface 54*a* and the lower wedging surface 56*a* are provided radially outside of, and circumferentially around, the longitudinal axis I-I. Similarly, the sealing ring 52 is provided circumferentially around and outside of the longitudinal axis I-I.

Relative axial movement between the lower wedging surface 56*a* and the upper wedging surface 54*a* in a direction towards each other provides radial expansion of the sealing element 52. As the sealing ring 52 comprises a plurality of thimble-shaped elements, each element will move a relatively small distance away from other elements when going from the retracted state to the expanded state. However, the outwardly curved area 72 of one element will still be at least partially inserted into the inwardly curved area 73 of the adjacent element and the thimble-shaped elements will still form a torus-shaped ring (thought with a larger diameter in the expanded state than in the retracted state).

The term "wedging surface" is used herein to describe a surface which, when moved towards another "wedging surface", will wedge the sealing ring 52 radially outwards. It should be noted that both of the wedging surfaces may have an acute angle with respect to a radial plane. However, it is also possible that one of the surfaces is oriented in the radial plane while the other one of the surfaces is provided with an acute angle with respect to the radial plane.

The upper wedging surface 54*a* is here provided in a lower end 18 of the main housing section 14.

The lower supporting element 56 is displaceable in relation to, and connected to the lower end 18 of the main housing section 14 by means of, a bolt 61. The bolt 61 comprises a head section 61*a*, a threaded end section 61*b* and an intermediate non-threaded section 61*c* between the head section 61*a* and the threaded end section 61*b*.

The threaded end section 61*b* is threadedly connected to a threaded opening 62 provided in the lower end 18 of the main housing section 14. The lower supporting element 56 comprises a through bore 57 slidingly arranged around the intermediate non-threaded section 61*c* of the bolt 61.

The lower supporting element 56 comprises a downwardly facing, substantially planar, supporting surface 58. This surface 58 defines the lower end of the well tool device 10.

The sealing device 50 further comprises a ratchet device 80 configured to allow relative axial movement between the lower wedging surface 56*a* and the upper wedging surface 54*a* in a direction towards each other while preventing relative axial movement between the lower wedging surface 56*a* and the upper wedging surface 54*a* in a direction away from each other.

Hence, if the lower supporting element 56 and the lower end 18 of the main housing section 14 are moved relatively towards each other, the ratchet device 80 will allow such movement. However, it is not possible for the lower supporting element 56 and the lower end 18 of the main housing section 14 to move away from each other again, due to the ratchet device 80. The ratchet device 80 comprise a finger element 81 having a first end 81*a* secured to lower end 18 and a second end 81*b* provided with a toothed surface engaging a toothed surface of a bore 82 provided in the lower supporting element 56.

Wheel Section 90

It is now referred to FIG. 10*a-d*, wherein it is shown that the well tool device 10 comprises a wheel section 90 comprising a set of wheels 92.

The wheel section 90 is located axially above the anchoring device 20 and below the upper connection section 11. In the present embodiment, the wheel section 90 is a part of the anchoring device 20, where the wheels 90 and the upper end 24*a* of the upper link element 24 are connected to a common bracket 29. Still, the wheels 90 are located axially above the slips element 22.

The wheel section 90 comprises three wheels 92. The purpose of the wheel section is to reduce friction during running of the well tool device into the well pipe WP and to reduce friction during retrieval of at least parts of the well tool device 10 from the well pipe WP. The purpose of the wheel section 90 is also to center the well tool device 10 in the well pipe WP.

It is now referred to FIG. 10*d*, showing the anchoring device in its run state. Here, the wheels 92, more precisely the outwardly facing surfaces of the respective wheels 92, are provided a first radial distance r92 from a longitudinal center axis I-I of the well tool device 10. Moreover, the radially protruding surface 22*a* of the slips element 22 is provided at a second radial distance r22*a* from a longitudinal center axis I-I of the well tool device 10. It is apparent that the first radial distance r92 is larger than the second radial distance r22*a*. Hence, the wheels also prevent the serrated surface 22*a* of the slips element 22 to accidentally come into contact with the inner surface of the well pipe during run or retrieval.

Operation of the Well Tool Device

Initially, it is referred to FIG. 2, where it is shown an upper weight W11 representing the weight of the upper connection section 11. As the center rod 12 is secured to this upper connection section 11, the weight of the center rod 12 will be included in this upper weight W11.

In FIG. 2, a lower weigh W14 is shown to represent the weight of the main housing section 14, including the weight of the heat generating mixture HGM.

The operation of the well tool device 10 will now be described with reference to FIGS. 11*a*-11*g*.

Figures 11A, 11B, 11C, 11D:
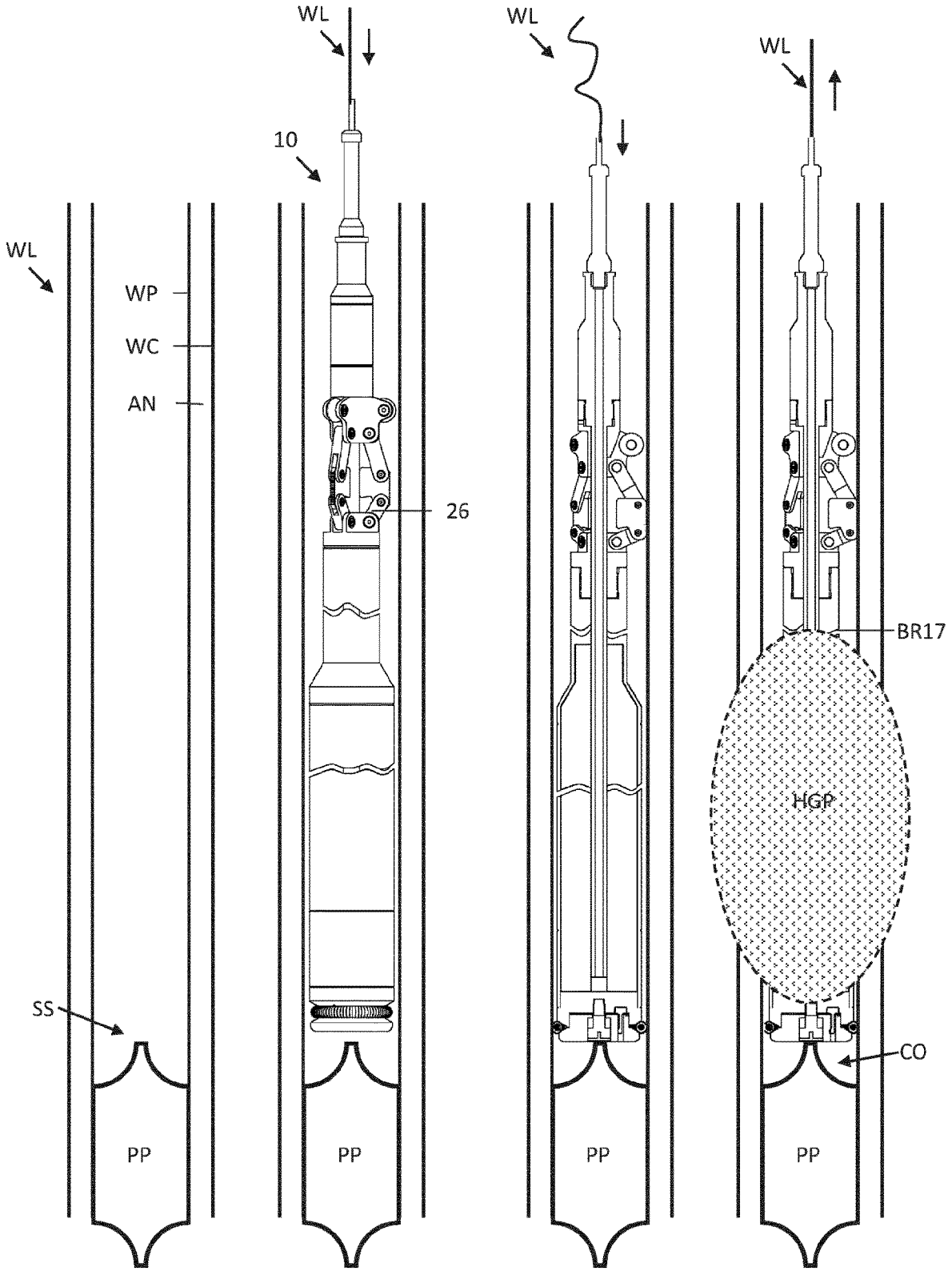

In FIG. 11*a*, it is shown an oil/gas well WL comprising a well pipe WP set inn the well WL. The well pipe WL may here be a production tubing. Radially outside of the well pipe WL there is an well casing WC secured to the formation by means of cement. An annulus is present between the well pipe WP and the well casing WC. The annulus may be filled with a fluid, or it may be filled with cement.

A permanent plug PP has been set in the well pipe WP. The upper part of the permanent plug PP is forming a supporting surface SS for the well tool device 10.

FIG. 11*b* shows that the well tool device 10 has been lowered into or run into the well pipe WP by means of a wireline WL to a position above the supporting surface SS. During this running operation, the weight W14 of the main housing section 14 is pulling the anchoring device 20 to its radially retracted state. As described above, the main housing section 14 is suspended via the lower link element 26 of the anchoring device 20, and hence the weight W14 will pull the anchoring device 20 downwardly and radially inwards to the retracted state.

FIG. 11*c* shows that the well tool device 10 has been lowered until the downwardly facing supporting surface 58 s supported against the supporting surface SS. As shown, there is no tension in the wireline WL. The weight W14 of the main housing section 14 is now pushing the upper wedging surface 54*a* downwards towards the lower wedging surface 56*a*, bringing the sealing device 50 from the radially retracted state to the radially expanded state. In the present embodiment, the sealing ring 52 is expanded into contact with the inner surface of the well pipe WP. When the sealing device is in its radially expanded state, the main housing section 14 becomes stationary with respect to the well pipe WP.

As the main housing section 14 now is stationary, the weight W11 of the upper connection section 11 will push the anchoring device 20 to the radially expanded state. The serrated surface of the slips element 22 will be brought into contact with the inner surface of the well pipe and the anchoring device 20 is now anchored to, or engaged with, the well pipe.

In FIG. 12*b*, the heat generating mixture HGM has been ignited or started and the hatched area represents a heat generating process HGP. The heat generation process HGP will melt the compartment subsection 15 and at least parts of the well pipe WP. In the present embodiment, the heat generation process HGP will melt also some of the materials radially outside of the well pipe WP, such as the well casing WC and cement present outside of the well casing WC. However, due to the distance subsection 17, the heat generation process HGP will not melt the anchoring device 20. Hence, as shown in FIG. 11*d*, the heat generation process HGP may melt parts of, but not the entire, distance subsection 17.

Due to the heat generating process HGP a fluid pressure will typically be built up. The purpose of the anchoring device 20 is to prevent that the main housing section 14 will be pushed upwards into the well pipe because of this fluid pressure. Hence, the heat generating process will be contained in the desired area of the well. This pressure can be large. However, due to lower link element 26 being shorter than the upper link element and/or due to the lower angle $\alpha$26 being larger than the upper angle $\alpha$24, a considerable force will push the serrated surface 22*a* of the slips 22 into the well pipe and prevent upwardly directed movement of the main housing section 14 during the heat generating process HGP.

A further consequence of the heat generating process HGP is that materials will become melted. The metal-to-metal seal provided when the sealing element 52 is radially expanded into contact with the well pipe WP will prevent or at least considerably reduce molten heat generating mixture and other molten materials (for example molten metal of the well pipe) to flow down to the area below the well tool device 10 during the heat generation process.

Yet another consequence of the heat generating process HGP is that fluid present in a compartment CO between the permanent plug PP and the supporting surface 58 will start to boil. Hence, another purpose of the metal-to-metal seal is also to prevent or at least considerably reduce the amount of fluid heated by the heat generation process to rise from the compartment CO below the well tool device 10 and up into the molten heat generating mixture during the heat generation process, as this may impact the process negatively.

In the final stage of the heat generating process HGP, the upper connection section 11, the anchoring device 20 and possibly also parts of the distance subsection 17 may be retrieved from the well pipe by pulling in the wireline, as indicated by the arrow adjacent to the wireline WL. The operation is now finished.

Figures 11E, 11F, 11G:
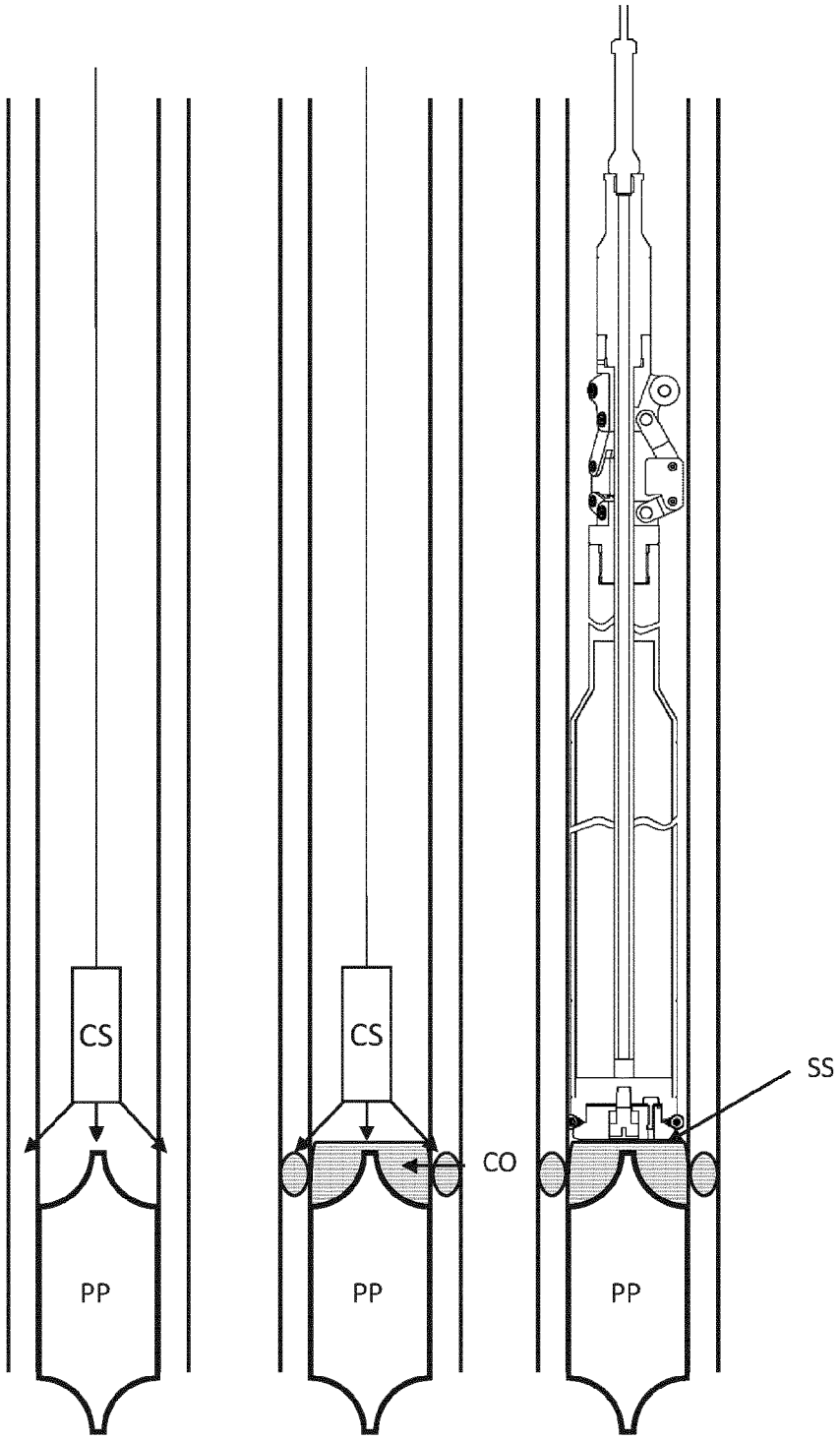

It is now referred to FIG. 11*e*, showing an optional step performed before the well tool device 10 is lowered into the well pipe WP. In this example, the annulus AN is fluid-filled. Here, a tool as described in WO2006098634 (CannSeal AS) WO2010147476 (CannSeal AS) or WO2019112438 (CannSeal AS) is used to first perforate the well pipe WP as shown in FIG. 11*e* by means of a tool CS.

Then, as shown in FIG. 11*f*, the tool CS is injecting a sealing material in fluid phase into the perforations, where the material in fluid phase subsequently will solidify to form a barrier in the annulus. Also the well pipe above the permanent plug may be filled with this material, to fill the compartment CO to avoid the above boiling challenges.

It is also possible to inject a particulate material into the perforations. It is further possible to inject a material such as heat generating mixture or a material being part of or affecting the heat generating process into the perforations, instead of or after the sealing material mentioned above.

In FIG. 11*g*, the well tool device 10 has been lowered onto the supporting surface SS formed by the injected and solidified material.

It should be noted that if the above perforation process has damaged the well pipe and made it difficult to obtain a metal-to-metal seal between the sealing ring 52 and the inner surface of the well pipe, the sealing device 50 of the well tool device may comprise several sealing rings 52 above each other, where each sealing ring 52 is expanded radially out towards the well pipe WP.

It should further be noted that the well tool device 10 may be set towards other supporting surfaces SS than a permanent plug. One example is the above injected and solidified material, the supporting surface SS may also be an inwardly protruding part of the well pipe WP, an upper end of a pipe string section located inside the well pipe etc.

It should further be noted that some pipes have variations in their inner diameter and also their shape may vary (for example slightly oval cross section instead of perfectly circular cross section). Hence, in some cases, the thimble-shaped elements are not expanded entirely into contact with the well pipe WP. The radially expanded sealing ring will still reduce molten heat generating mixture to flow down and/or reduce fluid heated by the heat generation process to rise.

Further Alternative Embodiments

Some alternative embodiments have been described above. It is now referred to FIG. 13*a*, 13*b*, 13*c*, where an alternative embodiment of the anchoring device 20 is shown.

This alternative embodiment has many similarities with the above described embodiment, and only differences between the embodiments will be described herein.

The main difference is that here, the anchoring device 20 does not comprise a separate slips element pivotably connected between the upper link element 24 and the lower link element 26. Instead, the lower end of the upper link element 24 is pivotably connected directly to the upper end of the lower link 26, as indicated by the one, common pivoting point indicated as P2, P3 in FIG. 13*a*.

The radially outwardly facing surface 22*a* is here provided on the lower link element 26. Alternatively, it can be provided on the upper link element 24.

Here, the first stop 22*e* is provided on the upper link element 24 while the second stop 26*e* is provided on the lower link element 26. Similarly to the above embodiment, the lower angle α26 between the lower link element 26 and a longitudinal center axis I-I of the well tool device 10 has a maximum value α26max when the first stop 22*e* and the second stop 26*e* is engaged with each other.

Moreover, it is shown in FIG. 13*a* that the anchoring device 20 also comprises a third, inwardly facing, stop 22*c*. Also here the stop 22*c* is provided in contact with the centre rod in the run state. In this embodiment, the stop 22*c* is provided as part of the lower link element.

The invention claimed is:

1. A well tool device for transporting a heat generating mixture (HGM) configured to undergo an ignition into a well pipe, wherein the well tool device comprises:

an upper connection section;

a main housing section comprising a compartment for the HGM; and an anchoring device connected between the upper connection section and the main housing section;

wherein the main housing section comprises a compartment subsection and a distance subsection;

wherein the compartment is a fully enclosed and separate compartment with continuous walls located within the compartment subsection; and wherein the distance subsection is located above the compartment subsection.

2. The well tool device according to claim 1, wherein the anchoring device comprises:

an upper link element pivotably connected to the upper connection section;

a lower link element pivotably connected to the distance subsection;

a radially outwardly facing surface with serrations for engaging the well pipe in a set state;

wherein a length of the upper link element is longer than a length of the lower link element.

3. The well tool device according to claim 2, wherein the radially outwardly facing surface is provided on the upper link element or on the lower link element or on a slips element pivotably connected between the upper link element and the lower link element.

4. The well tool device according to claim 3, wherein an upper end of the upper link element is pivotably connected to the upper connection section and a lower end of the upper link element is pivotably connected to an upper end of the slips element; and wherein an upper end of the lower link element is pivotably connected to a lower end of the slips element and a lower end of the lower link element is pivotably connected to the distance subsection.

5. The well tool device according to claim 1, wherein a weight of the main housing section is configured to pull the anchoring device to a radially retracted state when the well tool device is suspended from a wire or wireline connected to the upper connection section.

6. The well tool device according to claim 1, wherein a weight of the upper connection section is configured to push the anchoring device to a radially expanded state when the well tool device below the anchoring device is held stationary with respect to the well pipe.

7. The well tool device according to claim 1, wherein the anchoring device comprises a serrated surface configured to prevent upwardly directed movement of the main housing section after the ignition of the HGM.

8. The well tool device according to claim 1, wherein the anchoring device comprises:

slips element or an upper link element comprising a first stop; and a lower link element comprising a second stop;

wherein a lower angle between the lower link element and a longitudinal center axis of the well tool device has a maximum value when the first stop and the second stop are engaged with each other.

9. The well tool device according to claim 1, further comprising:

three sets of upper link elements, slips elements, and lower link elements distributed around a circumference of the anchoring device.

10. The well tool device according to claim 1, further comprising a wheel section comprising a set of wheels.

11. The well tool device according to claim 10, wherein the set of wheels are provided a first radial distance from a longitudinal center axis of the well tool device, wherein a radially protruding surface is provided at a second radial distance from a longitudinal center axis of the well tool device, and wherein the first radial distance being larger than the second radial distance.

12. The well tool device according to claim 1, further comprising:

a sealing device provided below the main housing section, wherein the sealing device comprises:

a lower supporting element comprising a lower wedging surface;

an upper wedging surface faced towards the lower wedging surface; and a sealing ring provided between the lower wedging surface and the upper wedging surface;

wherein a sealing element comprises a plurality of thimble-shaped elements inserted into each other to form a torus; and wherein relative axial movement between the lower wedging surface and the upper wedging surface in a direction towards each other provides radial expansion of the sealing element.

13. The well tool device according to claim 1, wherein a weight of the main housing section is configured to pull the anchoring device to a radially retracted state when the well tool device is suspended from a wire or wireline connected to the upper connection section; and wherein a weight of the upper connection section is configured to push the anchoring device to a radially expanded state when the well tool device below the anchoring device is held stationary with respect to the well pipe.

* * * * *